US006374757B1

(12) United States Patent
Farkash

(10) Patent No.: US 6,374,757 B1
(45) Date of Patent: Apr. 23, 2002

(54) CREDIT CARD SECURITY DEVICE

(76) Inventor: Avner Farkash, Yakir 246, D.N. Shomron (IL)

( * ) Notice: Subject to any disclaimer, the term of this patent is extended or adjusted under 35 U.S.C. 154(b) by 0 days.

(21) Appl. No.: 09/453,092

(22) Filed: Dec. 2, 1999

(51) Int. Cl.[7] ..... E05B 73/00

(52) U.S. Cl. ..... 109/23; 70/58; 70/63; 70/276; 109/24; 206/37; 206/38; 206/449; 340/568.7

(58) Field of Search ..... 70/57, 57.1, 58, 70/63, 276; 206/37, 38, 449; 109/23, 24, 30, 31, 38; 340/5.73, 568.1, 568.7, 571

(56) References Cited

U.S. PATENT DOCUMENTS

| | | | | | |
|---|---|---|---|---|---|
| 4,202,445 | A | * | 5/1980 | Porter | 206/37 |
| 4,584,571 | A | * | 4/1986 | Smit et al. | 340/572 |
| 4,721,948 | A | * | 1/1988 | Lin | 340/568 |
| 4,804,826 | A | | 2/1989 | Hertzen et al. | 235/382 |
| 4,942,831 | A | | 7/1990 | Tel | 109/29 |
| 5,598,792 | A | | 2/1997 | Wales | 109/23 |
| 5,938,010 | A | * | 8/1999 | Osterbye | 206/38 |
| 6,050,014 | A | * | 4/2000 | Ohlson | 206/37 X |

FOREIGN PATENT DOCUMENTS

| | | | | |
|---|---|---|---|---|
| CA | 2142959 | * | 8/1996 | |
| CA | 2192892 | * | 6/1997 | |
| EP | 014948 | * | 6/1984 | 340/571 |

* cited by examiner

*Primary Examiner*—Lloyd A. Gall
(74) *Attorney, Agent, or Firm*—Mark M. Friedman

(57) ABSTRACT

A device for preventing unauthorized use of data carriers, such as credit cards, ATM cards, and flexible discs, including: (i) a casing having at least one pocket having an opening, the pocket adapted to receive at least one card, and (ii) inner workings, disposed within the casing, the inner workings including a magnet affixed to a sliding arm, the sliding arm held in place by the card, such that unauthorized removal of the card through the opening allows the sliding arm to slide such that the magnet deactivates a magnetic strip disposed on the card.

17 Claims, 9 Drawing Sheets

CREDIT CARD SECURITY DEVICE

FIELD AND BACKGROUND OF THE INVENTION

The present invention relates to a device for preventing unauthorized use of card- or disk-shaped proofs of legitimacy and/or data carriers, such as ATM cards, credit cards and flexible disks and, in particular, to a mechanical device for preventing such unauthorized use.

Consumers are vulnerable to credit card and bank card fraud when a card is lost or stolen. Safety programs proposed and used up to now—e.g. centralized "on line" stop payment registers—have not proven to be sufficiently effective. Moreover, no solution has been found to the problem of bridging the frequently long time interval from the point of time at which the true card owner loses his card up to the point of time at which the corresponding information has been entered in a computer file. Often the credit-card owner does not realize that the card is missing until after the unauthorized use of the card. Thus, such safety procedures do not provide comprehensive protection from the vantage point of the consumer.

Although methods for preventing credit card and bank card fraud have been developed, such as applying a photograph of the owner or a reflection hologram to the card, such solutions have proven cumbersome and/or expensive. In any event, these security-oriented methods can only be implemented in a centralized fashion. In the absence of, and perhaps even in addition to centralized protection, the individual consumer desires local, personal protection.

It is previously known to electronically validate credit cards and the like each time before they are used, thereby to prevent improper use. For example, DE 3,131,761 discloses a device for this purpose. Such devices require, however, that the receiver of the card or data carrier has recourse to electronic equipment indicating whether the correct validating operation has been made. In contrast the present invention requires no recourse to external data equipment of any kind.

The most effective method for preventing the fraud is to invalidate the stolen or lost card and to preventing its use altogether. A device of this kind is known from French Patent Application 2,445,429. In the known device the security shield consists of two electrically conducting layers which are separated from each other by an insulating layer and which are disposed against or preferably in the walls of the container. The processing circuit is arranged in such a way that if a short-circuit occurs between the electrically conducting layers which are separated from each other, the damaging means are activated. The safety container is large, the object being the protection of large-scale conveying between defined locations. The manufacture of the container and the mechanism thereof is intricate and requires great precision, making such devices costly. The safety enclosures described are also very large and are impractical for routine personal use.

Great-Britain Patent No. 2,006,322 discloses a safety enclosure for credit cards, provided with a mechanical-combination lock and mechanical means causing projecting of a material which makes the credit cards unusable with a break-in attempt. Said mechanical means are sensitive and thus bring a danger of accidental triggering even for the authorized user.

U.S. Pat. No. 4,722,435 to Mareels et al. discloses a small case which may be put in a pocket by the user thereof, and which allows conveying valuable documents on a personal basis. The case encloses a capsule containing a liquid that can destroy or make unusable the documents. The capsule is made from a fusible material, as a whole or in part, and may also be closed with a plug made from such a material. The case comprises electric means for opening or unplugging the capsule in the case of a break-in attempt on the case.

U.S. Pat. No. 5,598,792 to Wales discloses a credit card security device for preventing credit card fraud. The device includes a case with an access door secured by a lock for storing the cards and a detection member within the case for determining an entry into the case when the door is locked. The detection member operates an electromagnet within the case upon entry. The electromagnet scrambles the code contained in the magnetic strip of each credit card, thereby invalidating the credit cards for future use. The detection member comprises a normally open electrical circuit when the door is closed and locked and includes switches for providing a current flow to the invalidating electromagnet upon the entry. At least one such switch is a normally open pressure switch mounted in the wall of the case, which closes when the entry to the case is through the wall, thereby providing the current flow to the electromagnet. Another switch is associated with the lock and is open when the lock is unlocked, thereby precluding a current flow through the circuit. The switch closes when the door is forcibly opened while locked, thereby providing the current flow to the electromagnet and invalidating the credit cards stored within the device.

U.S. Pat. No. 4,942,831 to Tel discloses a safety box comprising a multi-layered wall having provided therein at least one conductor, which responds by interruption or short-circuiting to damage caused to the wall, and which, if the wall is damaged, activates a circuit connected to said conductor. In response to activation of said circuit, documents contained in said safety box are marked or destroyed via an ignition means. The wall of the safety box is provided with electric shield means. In order to increase the response reliability of the circuit, the invention provides the feature that the shield means is galvanically separate from the circuit.

The above-mentioned security devices have several drawbacks. The electrical circuitry complicates the device and necessitates a power source. Moreover, fluctuations or temporary curtailment of current from the power source can trigger the deactivation mechanism, thereby rendering the stored cards useless. The devices are heavy and bulky, making routine personal use impractical. In addition, the sophistication of the mechanisms appreciably increases production costs.

U.S. Pat. No. 4,804,826 to Hertzen discloses a device for preventing unauthorized use of data carriers, such as ATM cards, credit cards and flexible disks, comprising a cover or case-shaped device or the like having at least one pocket or the like adapted to receive at least one card, disk, etc., actuators and control means arranged in said pocket, said control means being adapted to control said actuators and preferably being of the code lock type and comprising one or more means which, when actuated in a certain sequence or in a certain combination, are adapted to control said actuators. The actuators comprise means which are activatable when an attempt at gaining access is made without proper actuation of said control means and which, in the event of such an attempt at unauthorized access, are adapted to permanently mechanically damage said card, disk etc. and/or the data carried thereon.

The disclosed embodiments include chemical, mechanical, magnetic, and electrical actuators. Regarding magnetic actuators, it is taught that the device is characterized by actuators comprising at least one magnet or the like adapted to negatively affect the information magnetically stored on said card or disk when an attempt at removing said card is made without proper actuation of said control means.

A mechanical embodiment of the device may comprise a cover- or case-shaped card holder having at least one insert opening which is adapted to the cross-section of the credit card. The card holder may accommodate a plurality of actuating or marking means provided with marking or cutting edges and activated by external control means, and preferably eccentric holding means which allow insertion of a card into the holder, but which on extraction of the card urge it against the side where the marking means are positioned. By setting correctly the control means which may consist of laterally displaceable buttons, the edges of the actuating or marking means can be moved away from the card, whereupon the authorized user can readily extract the card. However, if an attempt at extracting is made without the correct setting, the surface of the card will be cut or scratched. As a result of the damage to the card, the receiver will notice immediately that the card is being used without authorization.

In a preferred embodiment provided in the above-mentioned patent, the container comprises an outer casing and an inner part. The outer casing is completely closed except for a slot-shaped opening at one end. One side of the outer casing is provided with a keyboard and a display window for a minicalculator of the very flat type. The keyboard also serves as control means for actuating an encoding unit. On one side, the interior of the outer casing is provided with contact rails adapted to be in electric contact with sheet metal contacts situated in the inner part. The contact rails are connected with a protective winding or protective net comprising a large number of windings of thin conducting wire integrated with the material forming the outer casing. Any damage to the outer casing causes a control circuit to open or close, whereby the safety device is triggered.

One long side of the outer casing is provided with a hook-shaped recess and a through hole, the function of which will be described below. The inner part comprises an open frame and an end portion accommodating the locking means and the electronics unit. The frame is adapted to hold a plurality of credit cards or at least one credit card when the inner part is received in the outer casing. Loops of thin conducting wire are integrated with the frame like in the outer casing, and any damage to said conducting wire causes triggering of the safety device.

The inner part is locked mechanically in the outer casing, but the locking is controlled by an electronic component, which in turn is controlled by the keyboard. The mechanical locking means comprises a locking hook engaging the recess in the outer casing and being actuated by a push button which is moving in the opening in the outer casing. The locking hook and the push button are arrested in normal position by a locking arm, which in its nonactuated state prevents the button from being pressed. The locking arm is operated by an electromagnet or the like which, when activated, causes the locking arm to pivot away from its position, arresting the push button and the locking hook, provided however that the correct code has been entered on the keyboard.

Various embodiments of the above-mentioned U.S. Pat. No. 4,804,826 to Hertzen describe security devices with advantages relative to the known art. Like previously-mentioned devices, however, the disclosed security devices have significant drawbacks. It can be appreciated that the devices described above are sophisticated and generally include electrical circuitry to prevent successful removal of the card through the walls of the device. Such mechanisms complicate the device, necessitate a power source, and make the credit cards prone to accidental deactivation resulting from fluctuations and/or temporary curtailment of current from the power source. Moreover, the sophisticated mechanisms appreciably increase the cost of production. It must be emphasized that the needs of the consumer dictate that the device be reliable and robust, more importantly, that the device be compact and easy to use, and perhaps most importantly, that the device be inexpensive. Thus, due to the drawbacks in the prior art, no such device has been successfully introduced in the market, the acute need for such a security device notwithstanding.

Some of the prior-art mechanisms are actually simple and reliable regarding the unauthorized removal of the card via the normal mode of removal, e.g. door, slot, etc. The complication and expense associated with devices of the prior art primarily result from the need to protect against the unauthorized penetration through the walls of the device and substantially unimpaired removal of the card.

It would be advantageous to have a credit card security device that overcomes the various deficiencies inherent in the known devices. It would be of further advantage to provide the consumer with a device that is robust and reliable, and more compact, lightweight, simple to use and more economical than devices conceived heretofore.

SUMMARY OF THE INVENTION

According to the teachings of the present invention there is provided a device for preventing unauthorized use of data carriers, such as credit cards, ATM cards, and flexible disks, comprising a case-shaped device having at least one pocket or the like with a slot or opening, said pocket adapted to receive at least one card, disk, etc., a magnet affixed to a sliding arm, and a lock, said lock being adapted to control the sliding arm such that unauthorized removal of said card through said opening results in deactivation of the magnetic strip of said card.

In a preferred embodiment, the device comprises a case-shaped device having at least one pocket or the like with a slot or opening, said pocket adapted to receive at least one card, disk, etc., a magnet affixed to an arm, and a lock, said lock being adapted to control the arm such that unauthorized removal of said card through said opening results in deactivation of the magnetic strip of said card, and wherein said arm is affixed and positioned within said device such that prying apart walls of said device triggers said arm, resulting in deactivation of the magnetic strip of said card.

In another preferred embodiment, the motion of the arm and the magnet affixed thereto is a sliding action.

In another preferred embodiment, the device further comprises a spring or the like that exerts continual pressure on the side of the credit card, forcing the credit card to be pressed against the wall of the device, such that when unauthorized access of the credit card is attempted by prying apart the walls of the device, the credit card is pushed out of position, thereby releasing the arm and deactivating the credit card.

In another preferred embodiment, said lock comprises a protruding tooth, and said lock can be manipulated such that said protruding tooth blocks said sliding arm, thereby allowing the safe removal of said card.

In a preferred embodiment, said sliding arm comprises a protrusion that is held in place by said card, such that removal of said card while said protruding tooth on said lock is disengaged from said sliding arm, releases said sliding arm and results in deactivation of said card.

In another preferred embodiment, said protrusion on said sliding arm is attached to the casing of the device, such that prying apart the walls of said casing separates said protrusion from said card, thereby releasing said sliding arm and deactivating said credit card.

In yet another preferred embodiment, the device further comprises a safety snap that prevents inadvertent removal of the card by the user, such that accidental invalidation of the card is averted.

It is appreciated that no device is impregnable, and that those skilled in the art of "break-ins" can often succeed in opening security devices like those of the present invention. In a preferred embodiment, the inner workings of the device according to the present invention can be manufactured in several alternative configurations, without any visible differences in the outward appearance of the device, such that an individual attempting unauthorized access of the credit card through the walls of the device will have difficulty identifying the internal structure, thereby appreciably reducing the opportunity or successful removal of the card. Many modifications in the size, structure and placement of the global mechanism of the device are possible, as well as local modifications in the size, structure and placement of the spring acting on the credit card, the magnetic plate, and the sliding arm.

In another preferred embodiment, the device further comprises a keyhole through which said arm is cocked by a key before initial use and after improper withdrawal of the card.

As used herein in the specification and claims section below, the phrase "opportunity for successfully removing a card" and the like refer to the probability of removing a functional card in a relatively short period of time.

As used herein in the specification and claims section below, the phrase "unauthorized removal" and the like refer to the removal of the card—either through the slot or opening, or by prying apart the walls of the device—when the protruding tooth on the lock is disengaged from the sliding arm, such that removal of the card releases the sliding arm and results in deactivation of the card.

BRIEF DESCRIPTION OF THE DRAWINGS

The invention is herein described, by way of example only, with reference to the accompanying drawings, wherein.

DESCRIPTION OF THE PREFERRED EMBODIMENTS

The principles and operation of the credit card security device according to the present invention may be better understood with reference to the drawings and the accompanying description.

Figure 1:
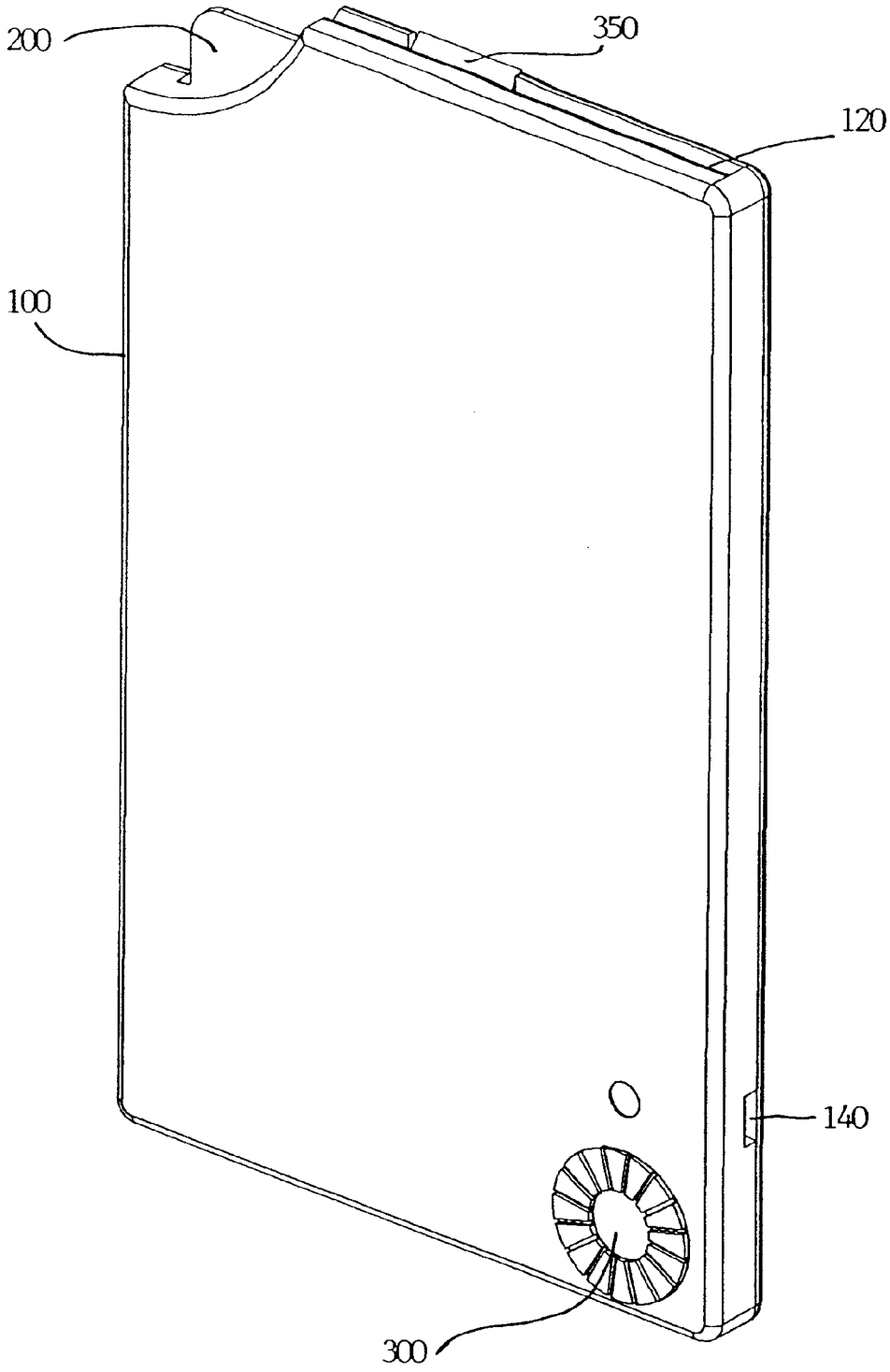
FIG. 1 is a schematic drawing of a credit card security device according to a presently preferred embodiment, with credit card secured in place.

Referring now to the drawings, FIG. 1 is a schematic drawing of a credit card security device according to a presently preferred embodiment. The outer dimensions are about 9 cm×6 cm×0.6 cm, allowing the device to fit into many standard wallets. A credit card 200 is secured in place inside casing 100 via a slot 120 in the short side of the casing 100. Affixed to the casing 100 is a circular code disk 300, described in further detail below, for activating and deactivating the internal mechanism. A safety snap 350, described in further detail below, is mounted on the short side of the casing 100 and protrudes over the slot 120, preventing the card 200 from slipping out or from other inadvertent removal. On the long, narrow side of the casing 100, just above the circular code disk 300 is provided a keyhole 140, through which a key can cock the mechanism before first-time use and in the event of accidental or unauthorized withdrawal of the card via the opening in the casing. The use of the key is described in further detail below.

Figure 2:
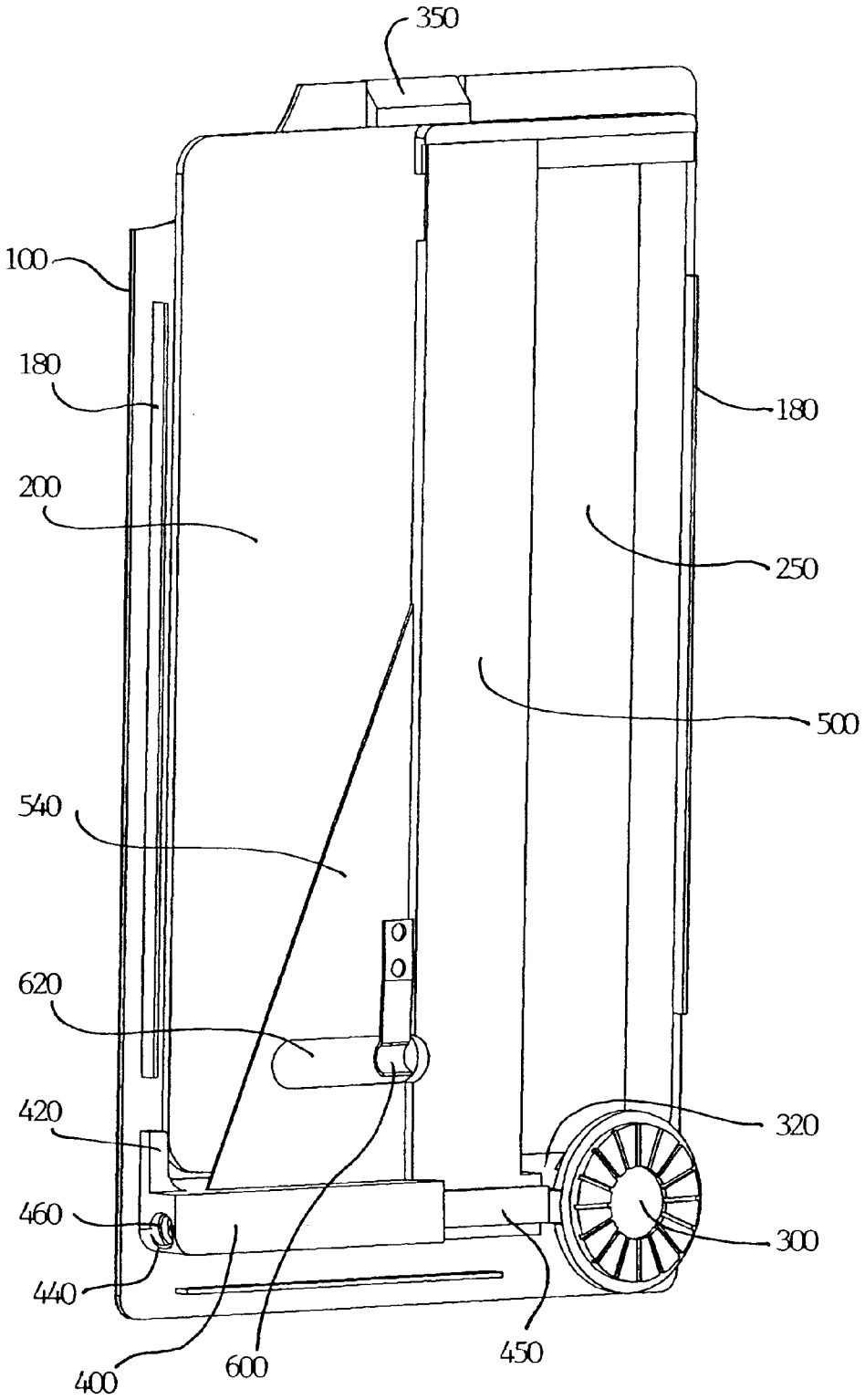
FIG. 2 is a schematic drawing of the inner workings of the device provided in FIG. 1.

FIG. 2 is an illustration of the device according to the present invention in which the front cover of the casing 100 has been removed to reveal the inner workings of the device provided in FIG. 1. Near the perimeter of the casing 100 are affixed strips 180 with a male orientation that match up with the corresponding female grooves on the front cover (not shown) of the casing 100, thereby securing the casing 100 closed.

The mechanism comprises a rectangular plate 500 attached to a sliding arm 400. The long dimension of the plate 500 corresponds to the long side of the casing 100. Along the long dimension of the plate 500, is affixed a plate-shaped magnet (shown below in FIG. 5). The plate 500 is supported by a triangular-shaped support 540 attached to the long side of plate 500 and to the top of the sliding arm 400. The sliding arm 400, which is positioned in parallel to the short side of the casing 100, is driven by a spring 460 compressed between the casing 100 and a round recess 440 in the sliding arm 400. The sliding arm 400 narrows down to a finger 450 at the end opposite the spring 460. The entire sliding arm mechanism is held in place by the pushing action of the credit card 200 against the protrusion 420 on the sliding arm. With the sliding arm 400 held in place, the magnet attached to the rectangular plate 500 is prevented from lining up with the magnetic strip 250 on the credit card 200, which would effectively disable the card.

Figure 6:
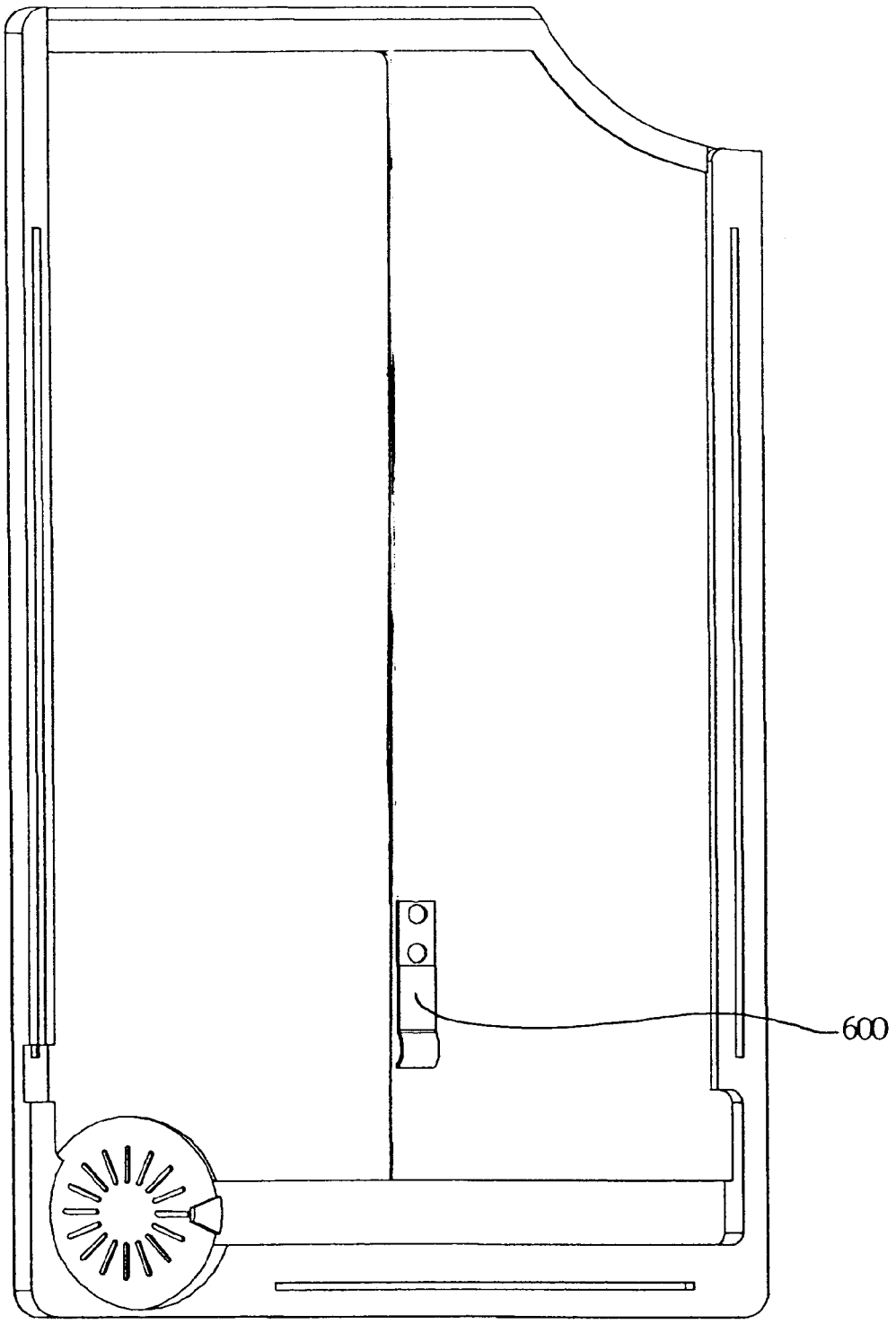
FIG. 6 displays the flat spring in a rear view of the previously provided device.

The device is further provided with a flat spring 600 mounted on the front cover of the casing, and a slot 620 that allows the sliding arm 400 to move without impairment. The function of the flat spring is described in FIGS. 6 and 7.

A safety lock 350 is mounted on the short side of the casing 100 and protrudes over the slot (not shown), preventing the credit card 200 from lipping out or from other inadvertent removal. To remove the card 200, the safety lock is snapped back, thereby providing sufficient clearance to remove the credit card 200 by way of the slot.

Figure 3:
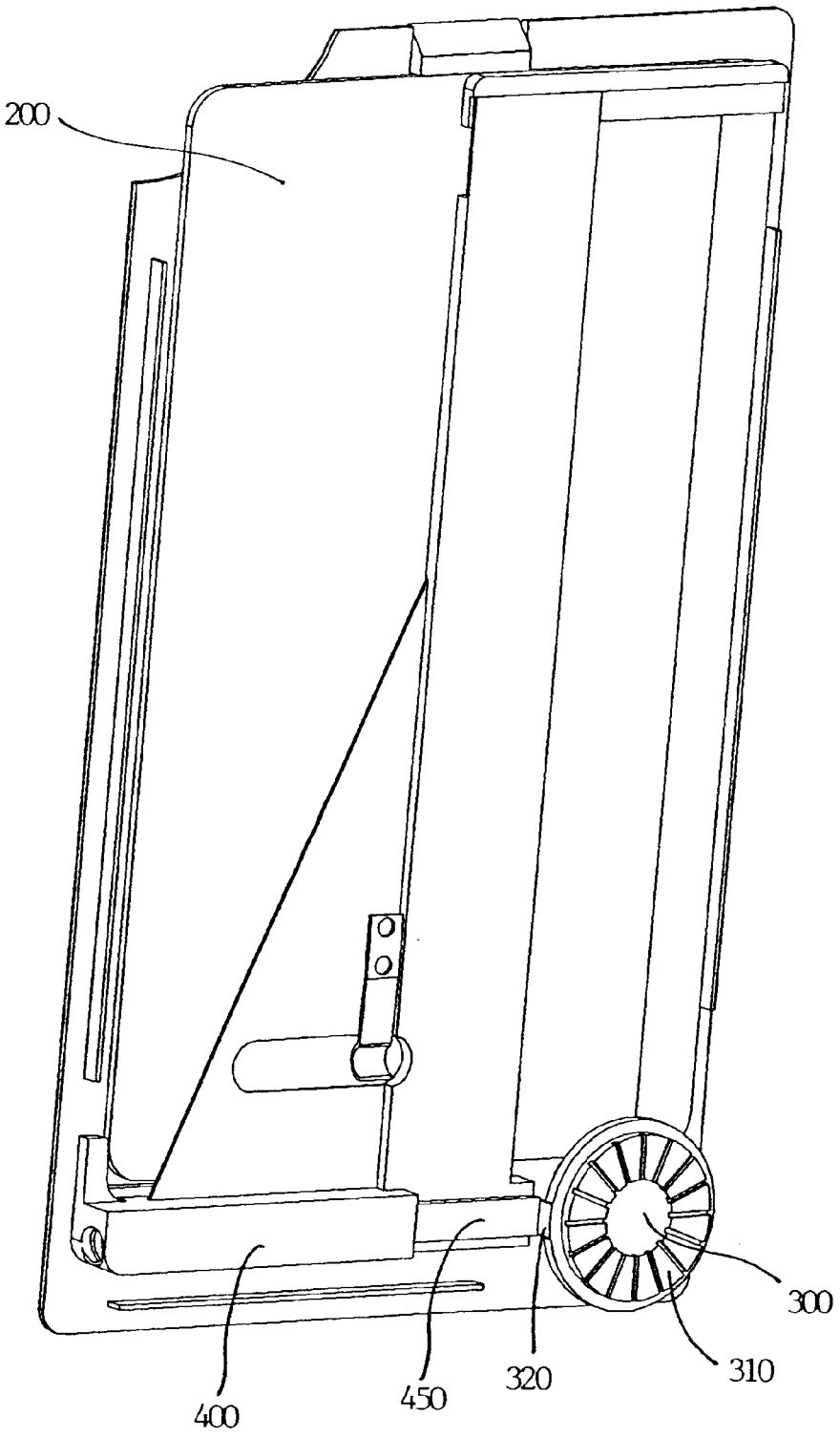
FIG. 3 illustrates the authorized withdrawal of a credit card secured in the device.

The function and method of operation of the circular code disk 300 with protruding tooth 320 is described in conjunction with FIG. 3.

FIG. 3 illustrates the device in authorized removal mode. The circular code disk 300 is provided with a protruding tooth 320 on the inner side of the disk. The circular code disk 300 is furnished with markings that divide the disk into annular sections 310, which are labeled with numbers and/or colors. The user is provided with the requisite code number or color. In authorized removal mode, the circular code disk 300 is rotated such that the requisite code number or color is properly aligned on the casing 100. With the circular code disk 300 properly aligned, the protruding tooth 320 on the inner side of the circular code disk 300 is aligned with the finger 450 extending from the sliding arm 400 such that the sliding arm is held in place. Thus, in authorized removal mode the credit card 200 is freely removed without risk of deactivating the credit card.

Figure 4:
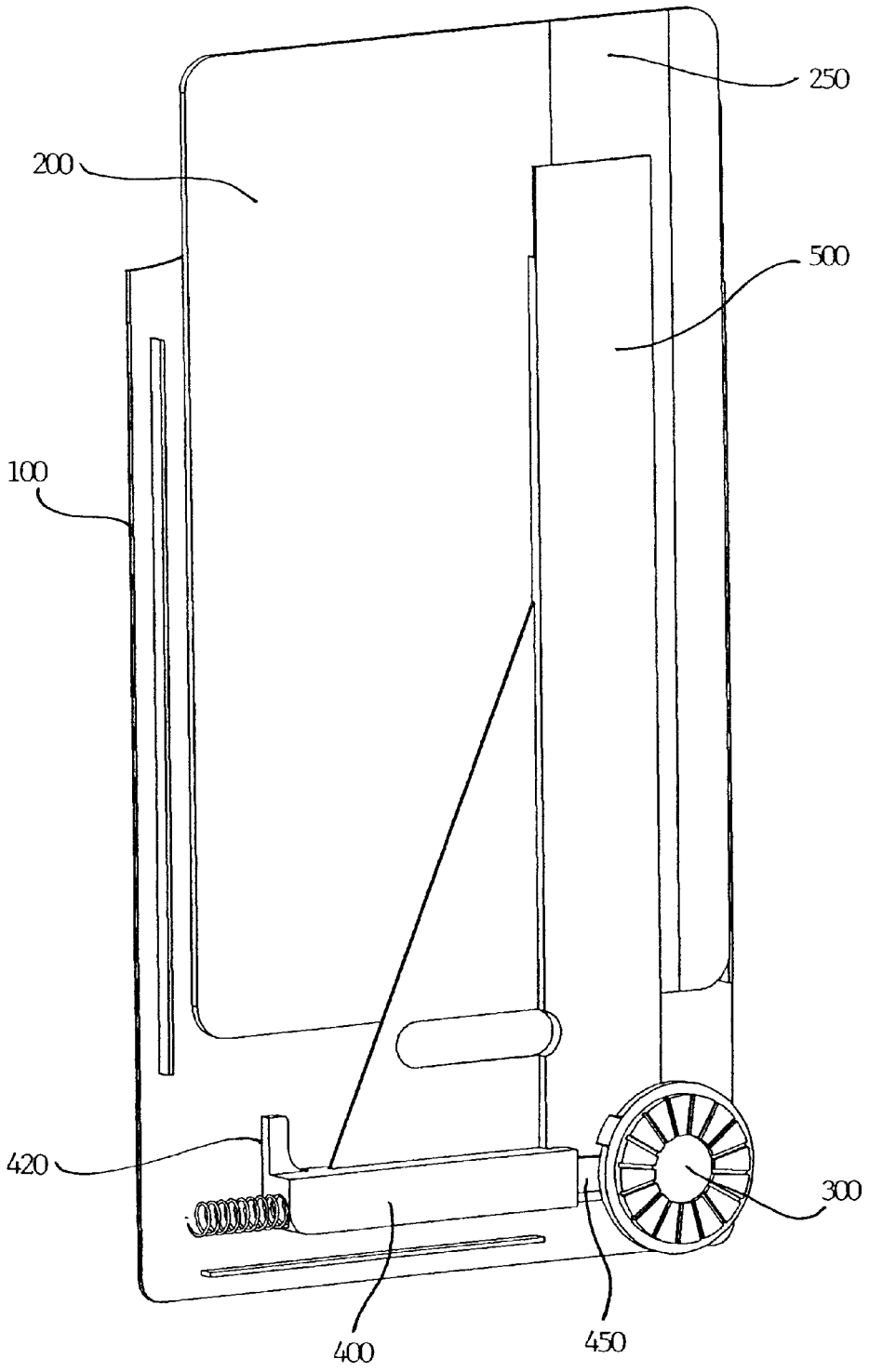
FIG. 4 is a schematic drawing of the inner workings of the device, in the process of invalidating a secured credit card during unauthorized withdrawal from the device.

The device previously provided in FIG. 2 is in protection mode, wherein the user is protected in the event that unauthorized removal of the credit card is attempted. In protection mode, the sliding arm 400 is held in place by the credit card 200 pressing against the protrusion 420 on the sliding arm 400, and the tooth 320 of the circular code disk 300 is disengaged from the sliding arm 400. FIG. 4 illustrates the unauthorized withdrawal of a credit card 200 secured in a device in protection mode. The removal of the credit card 200 without proper, "authorized" adjustment of the circular code disk 300 causes the spring 460 to push against the arm 400, such that the finger 450 at the end of the arm is free to slide behind the circular disk. The rectangular magnet (shown below) affixed to the rectangular plate 500, which in turn, is attached to the sliding arm 400, lines up with the magnetic stripe 250 to deactivate the credit card 200.

The height of the protrusion 420 can be as little as 1–2mm, such that deactivation of the credit card 200 occurs not only when the card is withdrawn completely from the casing 100, but even when the edge of the card 200 is pulled out by several millimeters.

Figure 5:
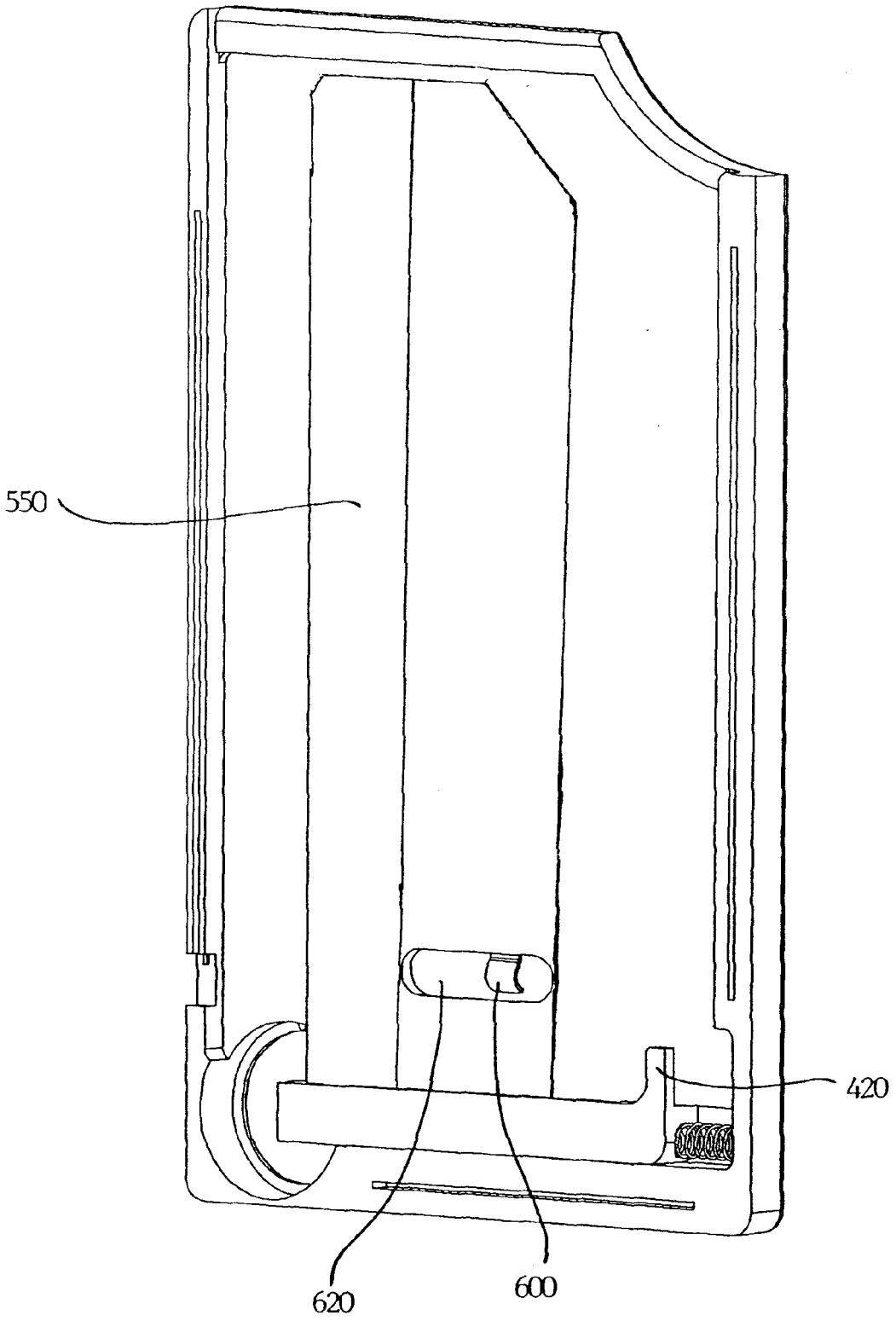
FIG. 5 provides a rear view of the mechanism illustrated in FIG. 4.

FIG. 5 illustrates a rear view of the device provided in FIG. 4, in which an unauthorized withdrawal of the credit card (not shown) secured in the device is attempted. The protrusion 420 is no longer pinned in place once the credit card is removed. Thus, the compressed spring, braced against the wall of the casing, exerts pressure on the short side of the sliding arm 400 such that the sliding arm is propelled, as described above. The rectangular magnet 550, which is shaped like the magnetic strip of a credit card (not shown), moves along with the plate 500 and the sliding arm 400 mechanism, lines up with the magnetic strip, and renders the credit card useless.

As described in FIG. 2, the sliding arm is normally held in place by the credit card pushing against the protrusion on the sliding arm. In protection mode, the sliding arm mechanism is activated by the removal or partial removal of the credit card via the slot. A different method of triggering the sliding arm mechanism is used when an attempt is made to access the card through the walls of the casing. In FIG. 2, a flat spring 600, mounted on the front wall (not shown) of the casing, and braced by the front wall, exerts continual pressure on the side of the credit card 200. The flat spring is better seen from the rear view of the device, provided in FIG. 6. The back cover of the device, plate and the triangular support therefor have been removed to reveal the flat spring 600. The flat spring is an oblong rectangular plate, with one end crimped to form a crescent or half-cylinder. The rectangular plate is bent forward slightly in the direction of the crimped end, such that the half-cylinder protrudes in the path of the credit card inserted through the slot. Hence, upon insertion of a credit card into the slot, the half-cylinder of the spring exerts continual pressure on the side of the credit card. The flat spring is preferably mounted near the bottom of the device, just above the sliding arm mechanism.

Figure 7:
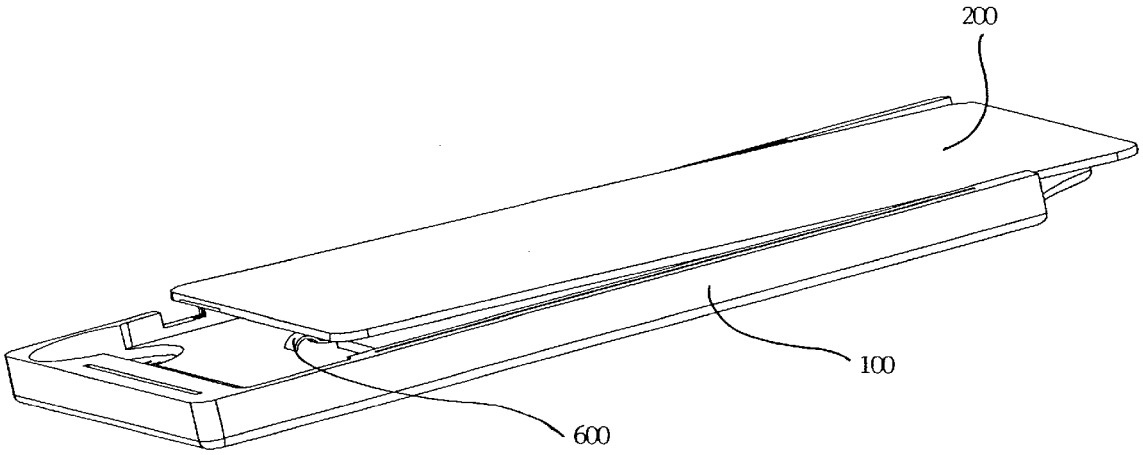
FIG. 7 provides a side view of the device provided in FIG. 6, in which a flat spring acts on the credit card when an attempt is made to pry apart the walls of the device.

FIG. 7 illustrates the previously provided credit card security device on which an attempt has been made to access the card through the wall of the casing 100. With the walls pried apart, there is nothing to brace the credit card 200 against the pressure of the flat spring 600, such that the credit card is displaced by the flat spring. Once the card 200 is displaced, the protrusion on the sliding arm (not shown) is no longer pinned in place. As previously described, the compressed spring exerts pressure on the short side of the sliding arm such that the sliding arm is propelled, thereby deactivating the credit card.

Figure 8:
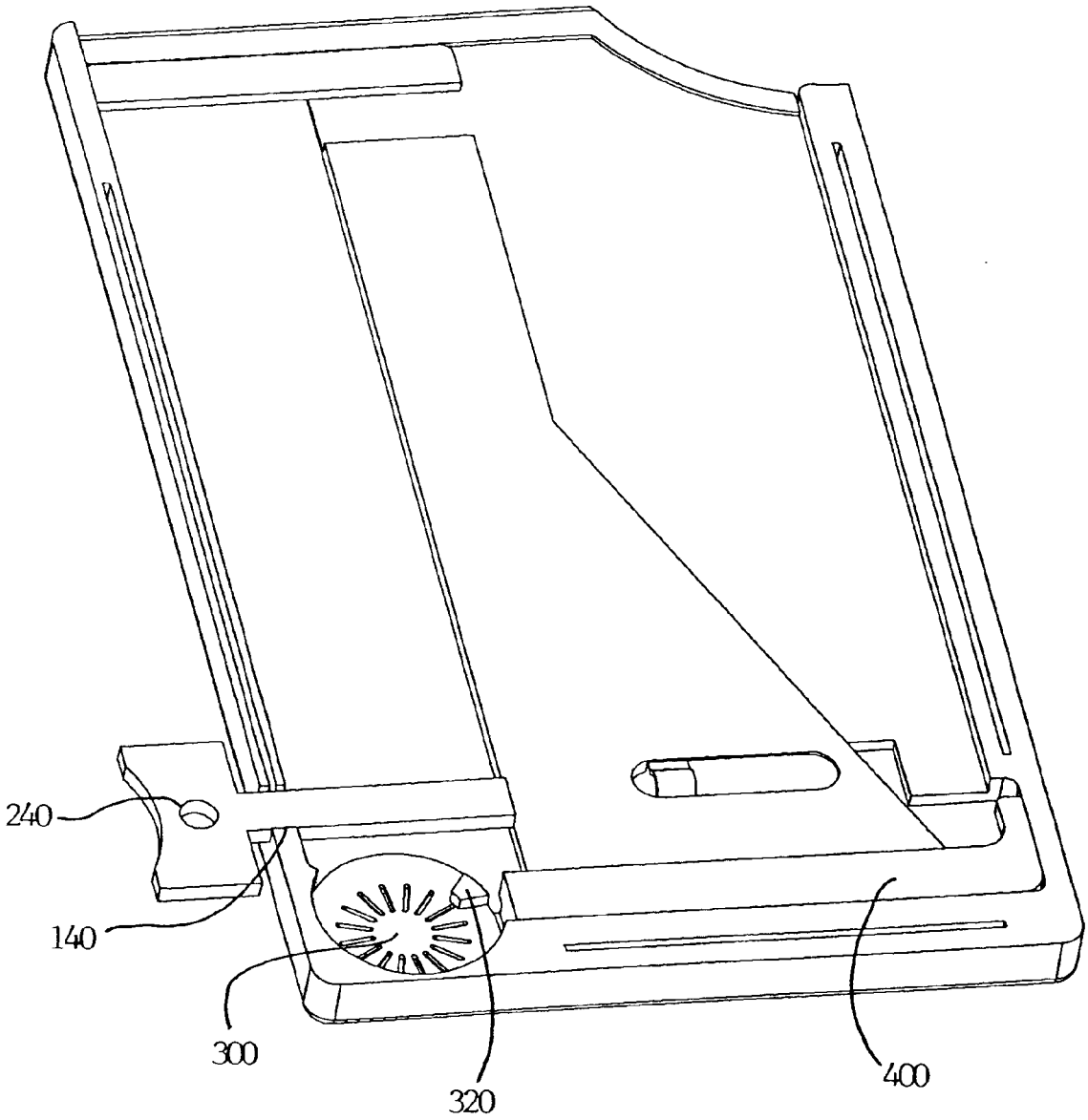
FIG. 8 is a schematic drawing of the inner workings of the device according to a presently preferred embodiment in which a key inserted in a keyhole in the casing is used to cock the mechanism before first-time use of the device or after unauthorized withdrawal of the credit card.

In another preferred embodiment, illustrated in FIG. 8, the device according to the present invention further comprises a keyhole 140 through which a key 240 is inserted. Before initial use of the device and after improper withdrawal of the card, the key 240 is used to cock the device by pushing back the plate 500 attached to the sliding arm 400. With the sliding arm 400 pushed back, the circular code disk 300 is turned to the proper code number and/or color, such that the tooth 320 protruding from the disk 300 lines up and blocks the sliding arm mechanism 400. The key 240 can then be removed, and the device is prepared for the insertion of a credit card.

Figure 9:
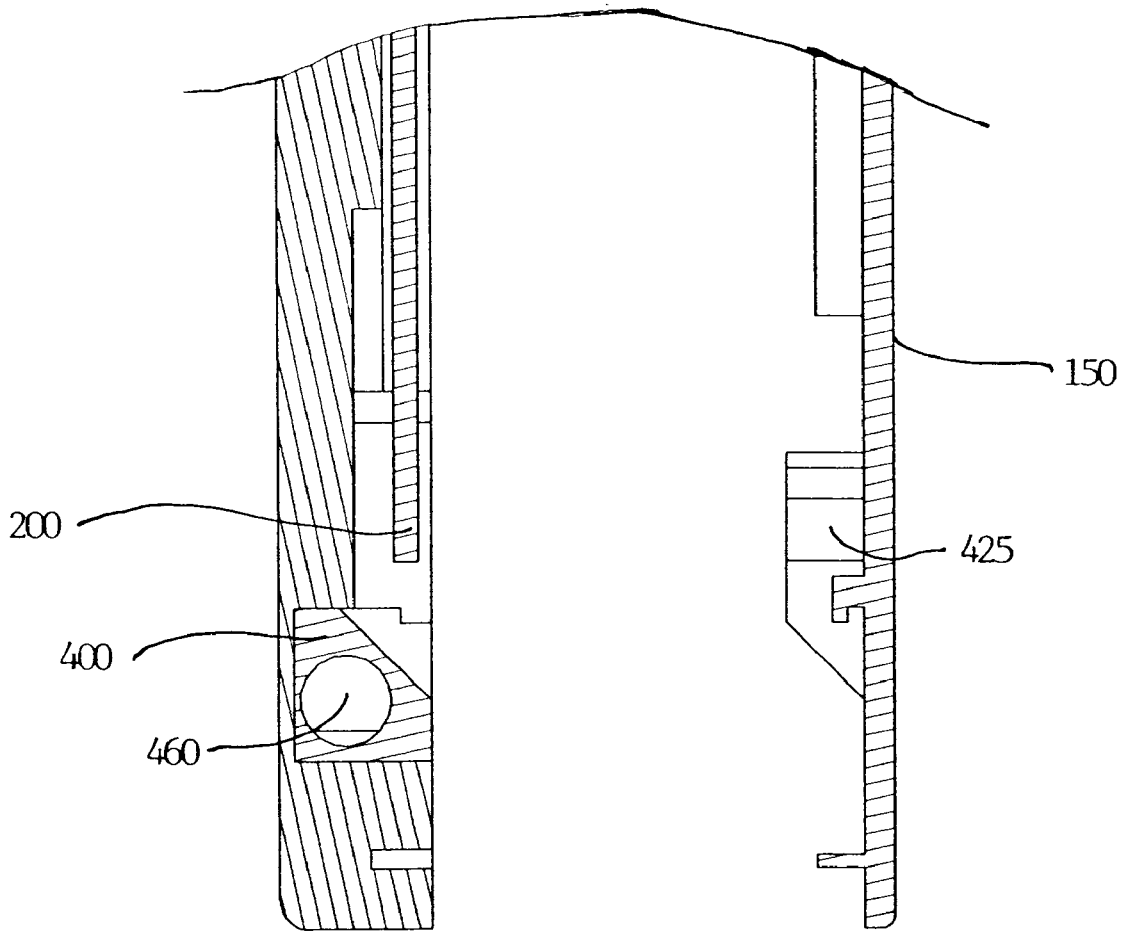
FIG. 9 provides a side view of a presently preferred embodiment of the device, wherein the protrusion is attached to the front wall of the casing.

In a preferred embodiment, the inner workings of the device according to the present invention can be manufactured in several alternative configurations, without any visible differences in the outward appearance of the device, such that an individual attempting unauthorized access of the credit card through the walls of the device will have difficulty identifying the internal structure, thereby appreciably reducing the opportunity for successful removal of the card. In FIG. 9, a side view of one such alternative configuration is shown by way of example. The previously illustrated protrusion on the sliding arm is no longer an integral part of the sliding arm. Instead, the protrusion 425 is a separate component affixed to the front panel 150 of the casing. With the casing closed, the device operates in substantially the same manner as the device described above. However, when the walls of the device are pried apart, the protrusion 425 is separated from the credit card 200 and the sliding arm 400 mechanism. As a result, the sliding arm 400 is no longer pinned in place, and the spring 460 propels the sliding arm 400, such that the magnet deactivates the magnetic strip of the credit card, as described above. In this preferred embodiment, no flat spring is necessary.

It can be appreciated that many modifications in the size, structure and placement of the global mechanism of the device are possible, as well as local modifications in the size, structure and placement of the spring acting on the credit card, the magnetic plate, and the sliding arm.

The device according to the present invention is compact and lightweight. Prototypes fashioned and tested for reliability and performance weigh only 20–50 grams. The outer dimensions are about 9 cm×6 cm×0.6 cm, allowing the device to fit into many standard wallets and the like. The device has no batteries or electrical circuitry, improving reliability and reducing production costs.

The device according to the present invention is designed to avoid the accidental triggering of the deactivation mechanism. Moreover, if improperly inserted, the card will not be deactivated. For example, if the card is inserted with the face of the card rotated by 180° such that the magnetic strip is on the proper side, but is translated out of position with respect to the magnet, or alternatively, with the face with the magnetic strip on the wrong side of the mechanism, deactivation of the card does not occur.

It will be appreciated that the above descriptions are intended only to serve as examples, and that many other embodiments are possible within the spirit and the scope of the present invention.

What is claimed is:

1. A device for preventing unauthorized use of data carriers, including credit cards, ATM cards, and flexible discs, comprising:

(i) a casing having at least one pocket having an opening, said pocket adapted to receive at least one card;

(ii) inner workings, disposed within said casing, said inner workings including a magnet affixed to a sliding arm, said sliding arm held in place by said card, such that unauthorized removal of said card through said opening allows said sliding arm to slide such that said magnet deactivates a magnetic strip of said card.

2. The device of claim 1, wherein said inner workings include a lock, said lock adapted to control said arm.

3. The device of claim 2, wherein said lock includes a protruding tooth, and wherein said lock can be manipulated such that said protruding tooth blocks said sliding arm, thereby allowing the safe removal of said card.

4. The device of claim 3, wherein said sliding arm includes a protrusion that is held in place by said card, and wherein said lock is manipulated such that said protruding tooth on said lock is disengaged from said sliding arm, such that the removal of said card releases said sliding arm and results in deactivation of said card.

5. The device of claim 3, further comprising a spring, said spring exerting a constant pressure on a side of said card, such that in prying apart walls of the device, said spring pushes said card out of position, thereby releasing said sliding arm and deactivating said card.

6. The device of claim 1, further comprising a keyhole through which said arm is cocked by a key that pushes said inner workings into place before initial use and after improper withdrawal of said card.

7. The device of claim 1, further comprising a safety lock, disposed on said casing, said safety lock protecting against inadvertent removal of said card by an authorized user.

8. The device of claim 1, wherein a protrusion is slidably attached to an inner side of said casing, said protrusion aligned so as to cooperate with said sliding arm, such that prying apart walls of said casing separates said protrusion from said card, thereby releasing said sliding arm and deactivating said card.

9. A device for preventing unauthorized use of data carriers, including credit cards, ATM cards, and flexible discs, comprising:

(i) a casing having at least one pocket having an opening, said pocket adapted to receive at least one card;

(ii) inner workings, disposed within said casing, said inner workings including a magnet affixed to an arm, wherein said arm is affixed and positioned such that prying apart walls of the device triggers movement of said arm along with said magnet affixed thereto, such that said magnet deactivates a magnetic strip of said card.

10. The device of claim 9, wherein said inner workings include a lock, said lock adapted to control said arm.

11. The device of claim 10, wherein said lock includes a protruding tooth, and wherein said lock is manipulated in a pre-determined manner such that said protruding tooth blocks said arm, thereby allowing the safe removal of said card.

12. The device of claim 11, wherein said arm includes a protrusion that is held in place by said card, and wherein said lock is manipulated such that said protruding tooth on said lock is disengaged from said arm, such that the removal of said card releases said arm and results in deactivation of said card.

13. The device of claim 9, further comprising a safety lock, disposed on said casing, said safety lock protecting against inadvertent removal of said card by an authorized user.

14. The device of claim 9, further comprising a keyhole through which said arm is cocked by a key that pushes said inner workings into place before initial use and after improper withdrawal of said card.

15. The device of claim 9, wherein a protrusion is attached to an inner side of said casing, said protrusion aligned such that prying apart walls of said casing separates said protrusion from said card, thereby releasing said arm and deactivating said card.

16. The device of claim 9, wherein said movement of said arm is a sliding movement.

17. A plurality of devices according to claim 9, each of said devices including inner workings having a unique internal configuration, and wherein each said configuration of said inner workings is substantially obscured from an outside view, such that an opportunity for successful removal of the said card by unauthorized access through walls of said casing is appreciably reduced.

* * * * *